United States Patent [19]

Holdredge, Jr.

[11] Patent Number: 4,653,649

[45] Date of Patent: Mar. 31, 1987

[54] MODULAR STORAGE DEVICE

[75] Inventor: Ernest C. Holdredge, Jr., Warrenville, Ill.

[73] Assignee: Ziff-Davis, New York, N.Y.

[21] Appl. No.: 773,468

[22] Filed: Sep. 9, 1985

[51] Int. Cl.[4] ..... A47G 19/08

[52] U.S. Cl. ..... 211/41; 211/131; 211/194

[58] Field of Search ..... 211/41, 78, 131, 129, 211/194; 312/239; 206/509

[56] References Cited

U.S. PATENT DOCUMENTS

| | | | |
|---|---|---|---|
| 465,621 | 12/1891 | Westphal . | |
| 503,306 | 8/1893 | Bever . | |
| 1,213,026 | 1/1917 | Sande | 312/202 X |
| 1,283,518 | 11/1918 | Hormes | 211/78 |
| 1,372,100 | 3/1921 | Seffert | 211/131 X |
| 1,471,594 | 10/1923 | Evans | 211/78 X |
| 2,525,538 | 10/1950 | Garvin | 211/78 X |
| 2,994,440 | 8/1961 | Catterall et al. . | |
| 3,124,398 | 3/1964 | Fuller et al. . | |
| 3,170,741 | 2/1965 | Richards, Jr. . | |
| 3,238,001 | 3/1966 | Allen et al. . | |
| 3,361,508 | 1/1968 | Chassevent . | |
| 3,421,801 | 1/1969 | Carpenter et al. . | |
| 3,529,879 | 9/1970 | Priest . | |
| 4,014,437 | 3/1977 | Rumble et al. | 211/78 X |
| 4,216,867 | 8/1980 | Sturm | 211/131 X |
| 4,249,318 | 2/1981 | Anderson et al. | 211/78 X |

FOREIGN PATENT DOCUMENTS

| | | | |
|---|---|---|---|
| 007506 | 12/1970 | Canada | 211/131 |
| 1330916 | 11/1963 | France | 211/131 |

*Primary Examiner*—Ramon S. Britts
*Assistant Examiner*—Sarah A. Lechok Eley
*Attorney, Agent, or Firm*—Dressler, Goldsmith, Shore, Sutker & Milnamow, Ltd.

[57] ABSTRACT

A modular storage device is disclosed which promotes convenient and efficient storage of microfilm cartridges or a plurality of like objects. The modular nature of the construction is provided by a plurality of unitary, vertically stackable rack members, selected numbers of which can be readily stacked upon the base of the unit. Each rack member is preferably of a generally circular configuration, and includes a plurality of outwardly extending support members, with adjacent ones of the support members adapted to support one of the film cartridges. For economical manufacture, each stacking rack member is configured for minimization of material, and further configured for fabrication from "structural foam" so that further material-savings can be effected. Convenient use and economical fabrication are further promoted by the configuration of the base of the unit, which together with the lowermost one of the rack members defines a pair of bearing races. The disposition of a plurality of ball bearings in the races thus permits the vertically stacked members to be rotated together with respect to the base.

15 Claims, 5 Drawing Figures

MODULAR STORAGE DEVICE

TECHNICAL FIELD

The present invention relates generally to storage racks and the like for storing a plurality of objects, and more particularly to a carousel-like storage device for a plurality of film cartridges or like objects which is modular in nature for tailoring its storage capacity to specific needs, and which is configured for economy of manufacture, and versatile and convenient use.

BACKGROUND OF THE INVENTION

Many businesses require devices for safely and conveniently storing a number of like or similar objects, such as for record-keeping. For example, some businesses maintain records on microfilm, with the microfilm held within generally rectangular, box-like film cartidges. In many businesses, it is not uncommon for access to hundreds or even thousands of such microfilm cartridges to be required on a day-to-day basis. Naturally, use of a large number of such film cartridges for storage and retrieval of information mandates the use of an arrangement for storing the cartridges in an organized manner so as to facilitate their convenient use on a regular basis.

While storage devices configured to store a fixed number of objects such as film cartridges can be useful for convenient storage thereof, a storage device which is modular in nature is far more versatile. A modular construction is preferably configured so as to facilitate convenient "customizing" or "tailoring" of the device so as to provide the storage capacity as may be required at any given location. A modular construction not only permits a storage device to be initially sized as requirements demand, but further permits the storage capacity of the device to be increased or decreased as may be later required.

Considering that very large storage capacities may be required in some instances, economy of manufacture becomes a key consideration. Even though a construction may be easy-to-use and/or versatile in nature, a device must be affordably priced if it is to find commercial acceptance.

In keeping with the above design goals, the storage device of the present invention has been particularly configured for versatility, convenience of use, and economy of manufacture.

SUMMARY OF THE INVENTION

The modular storage device embodying the principles of the present invention has been particularly configured for efficiently and conveniently storing a plurality of microfilm cartridges, or like generally rectangular objects. The modular nature of the construction is provided by a plurality of vertically stackable rack members, the number of which can be easily increased or decreased depending upon the needed storage capacity of the device. Not only is each rack member configured so as to minimize material required for its formation, but additionally is configured for rotational mounting on a base of the device. By this construction, the rack members can easily be rotated together relative to the base, thus facilitating convenient use of the cartridges or other objects stored in the unit.

The stackable rack members of the present storage device are positionable in vertically aligned relation on the base of the device, with each rack member being of unitary, one-piece construction, and having a generally circular configuration. In the illustrated embodiment, each rack member includes a generally vertically oriented circular inner portion, and a plurality of spoke-like, circumferentially spaced support members which extend integrally and freely outwardly from the circular inner portion. By this construction, the storage device is lattice-like in nature, thus permitting fabrication of the device for storage of a relatively large number of cartridges or other objects while minimizing the material required for formation.

Each support member of the rack members defines a pair of preferably generally vertically oriented opposite side surfaces which taper generally toward each other inwardly of each rack member. Each support member further includes a pair of support flanges disposed on respective opposite sides of the support member and extending away from the side surfaces thereof. In order to securely retain the objects stored in the device, the support flanges are preferably configured to support each object in an inwardly, downwardly inclined position. Additionally, the confronting side surfaces of adjacent ones of the support members are preferably disposed in generally parallel, spaced relation to each other, thus defining a receiving area between adjacent ones of the support members for receiving one of the objects to be stored, with each object supported upon the confronting support flanges of adjacent ones of the support members. Notably, each support member is substantially hollow, again with keeping with the desired minimization of material required for formation.

Vertical stacking of any selected number of the rack members is facilitated by the provision of interconnecting means generally at the upper extent and the lower extent of each support member whereby the lower interconnecting means of one of the support members cooperates with the upper interconnecting means of another one of the support members of the one of the rack members positioned therebeneath.

In the illustrated embodiment, the interconnecting means comprises a receiving groove at the lower extent of each support member, and an upper edge portion of each support member positionable within the receiving groove.of the support member thereabove. The provision of such interconnecting means not only vertically aligns the rack members, but further fixes the rack members against relative rotation with respect to each other. Secure vertical stacking is further facilitated by the provision of a downwardly opening annular groove defined by the inner portion of each rack member. This annular groove is configured for receiving the upper extent of the inner portion of another rack member positioned therebeneath.

Significantly, the annular groove defined by the inner portion of each rack member facilitates rotational mounting of the rack members on the base of the unit. Specifically, the base comprises an outer base portion which defines an upwardly opening annular groove which provides a first bearing race. The annular groove defined by the outer base portion is of generally the same diameter as the downwardly opening annular groove defined by the inner portion of each of the rack members. Thus, the annular groove defined by the lowermost one of the rack members provides a second bearing race whereby the disposition of ball bearings in the first bearing race defined by the base portion permits rotational mounting of all of the rack members on the base by cooperation of the ball bearings with the pair of bearing races thus provided. As will be recognized, this unique construction permits the rack members to be essentially identical in configuration and interchangeable, yet readily permits the lowermost one of the rack members to be rotational with respect to the base of the unit.

In order to retain the lowermost one of the rack members in association with the base for relative rotation, the base of the unit further includes an inner portion integral with the outer portion thereof. The inner base portion defines a plurality of circumferentially spaced retaining fingers each defining a retaining surface which coacts with the inner portion of the lowermost rack member to maintain that rack member on the base portion for relative rotation. Preferably, the retaining fingers are resiliently flexible, with each including a cam surface reactive with a cam surface defined by the inner portion of each rack member. By this construction, the lowermost rack member of the device can be moved downwardly onto the base whereby the retaining fingers are urged radially inwardly, whereafter the fingers spring back to their original orientation so that the retaining surfaces of the fingers react against the inner portion of the lowermost rack member to retain it for relative rotational movement.

In keeping with the preferred goal of economical manufacture, the present storage device has been configured to facilitate its formation from so-called "structural foam". This material comprises moldable plastic having a cellular core which increases in density toward the surface of the material. The cellular nature of this material desirably provides it with a relatively high strength-to-weight ratio, thus making it particularly suited for use in the storage device of the present invention since the strength required for storage of a very large number of objects can be obtained with very economical use of plastic material.

Numerous other features and advantages of the present invention will become readily apparent from the following detailed description, the accompanying drawings, and the appended claims.

DETAILED DESCRIPTION

Figure 1:
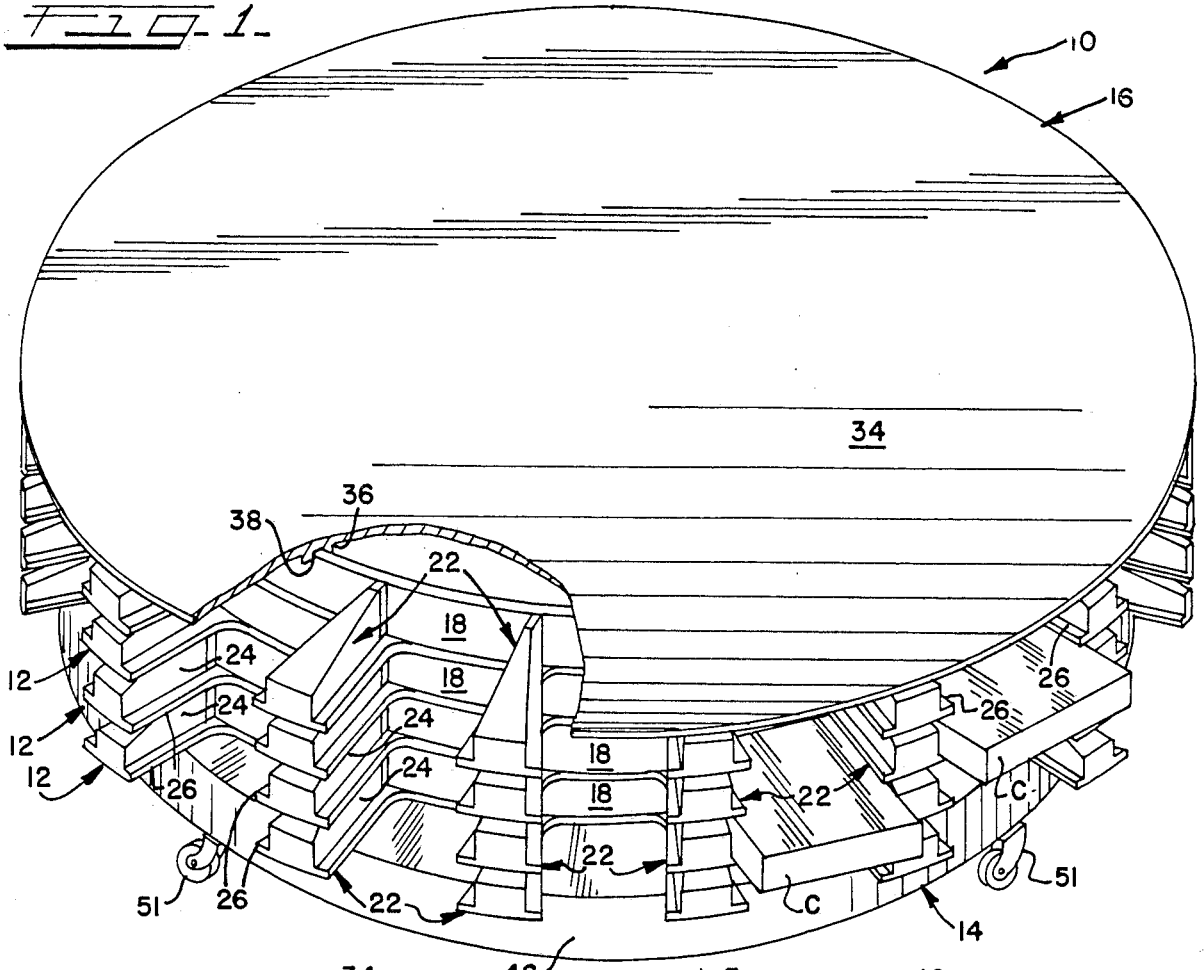
FIG. 1 is a perspective view illustrating a modular storage device embodying the principles of the present invention.

While the present invention is susceptible of embodiment in various forms, there is shown in the drawings and will hereinafter be described, a presently preferred embodiment, with the understanding that the present disclosure is to be considered as an exemplification of the invention, and is not intended to limit the invention to the specific embodiment illustrated.

With reference now to the drawings, therein is illustrated a modular storage device 10 embodying the principles of the present invention. As will be further described, storage device 10 is illustrated as configured for storing a plurality of box-like, generally rectangular microfilm cartridges, designated C, or like objects. As noted, the present storage device is preferably fabricated from "structural foam", thus facilitating economical fabrication by injection molding techniques. As will be appreciated, the exact configuration and dimensioning of the present storage device can be readily selected according to the type of objects to be stored therein, with the illustrated embodiment reflective of a commercial form of the invention for holding a relatively large number of the film cartridges C.

The modular nature of the present storage device is provided by a plurality of releasably vertically stackable rack members 12. Each rack member 12 is of unitary, one-piece construction, thus permitting almost any selected number of the rack members to be conveniently stacked upon each other to provide storage capacity as desired. This is a particularly desirable feature of the present invention since the storage capacity of the device can be very easily increased or decreased by its user.

In the preferred form, the storage device 10 is in the nature of a carousel, with the rack members 12 supported for rotational movement together on a base 14 of the unit. As will be further described, the base 14 is also of unitary, one-piece construction, and is configured to cooperate with the lowermost one of rack members 12 for rotationally supporting all of the rack members. The present storage device 10 further preferably includes a top cover member 16 which is removably positionable upon the uppermost one of the rack members 12, thus providing the overall storage device with an aesthetically pleasing appearance.

Figure 2:
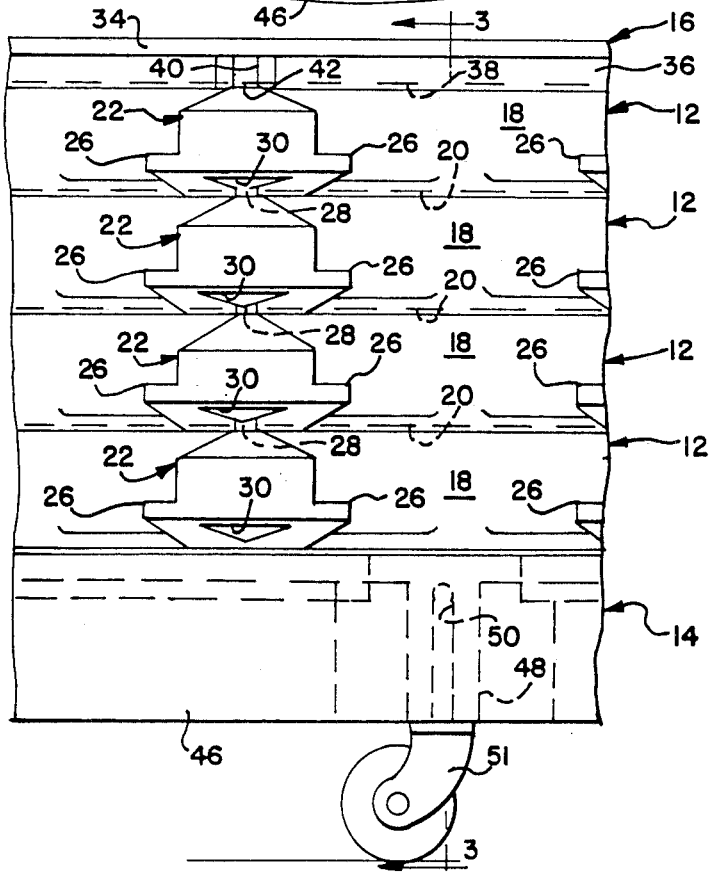
FIG. 2 is a partial side elevational view of the storage device shown in FIG. 1.
Figure 3:
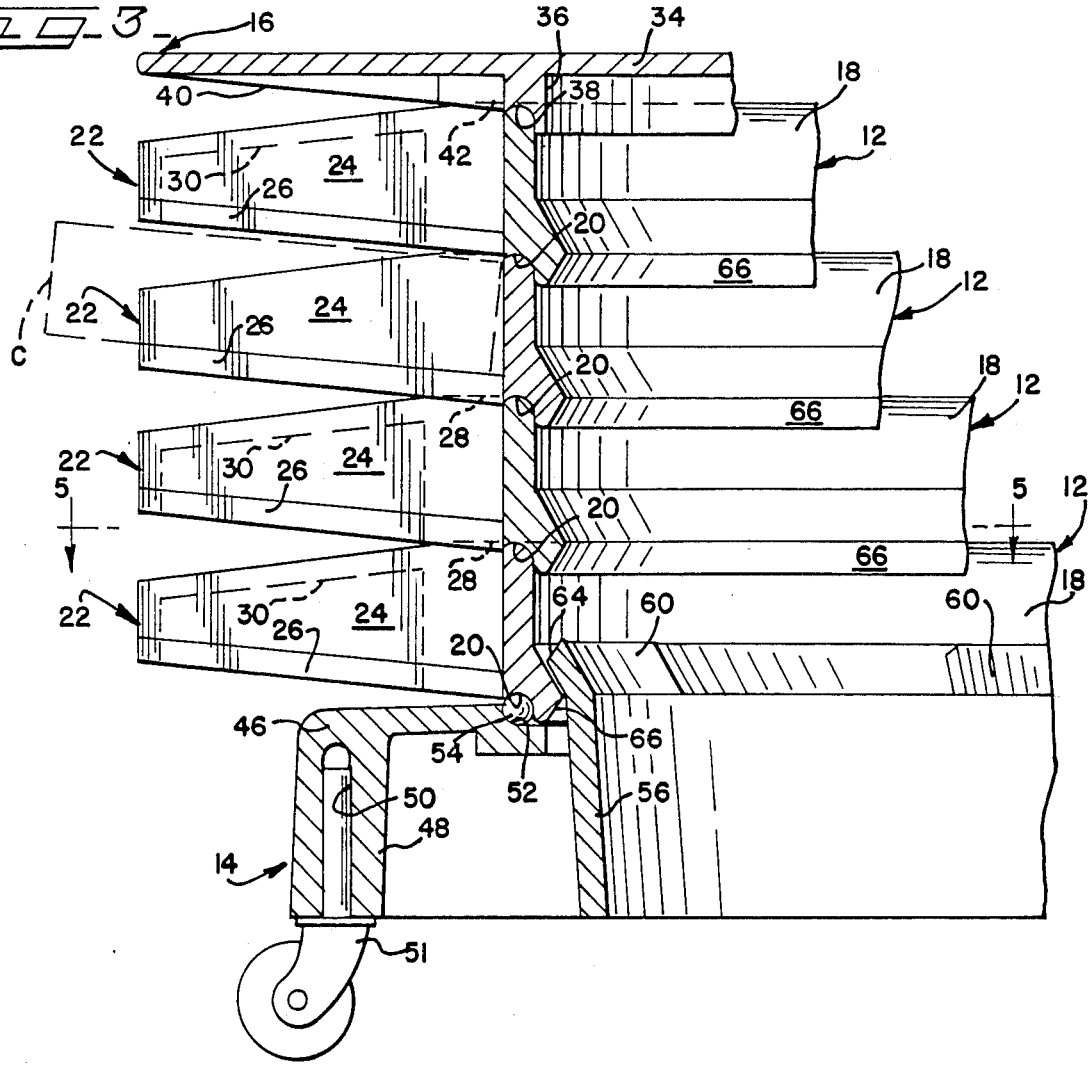
FIG. 3 is a partial cross-sectional view taken generally along lines 3—3 of FIG. 2.
Figure 5:
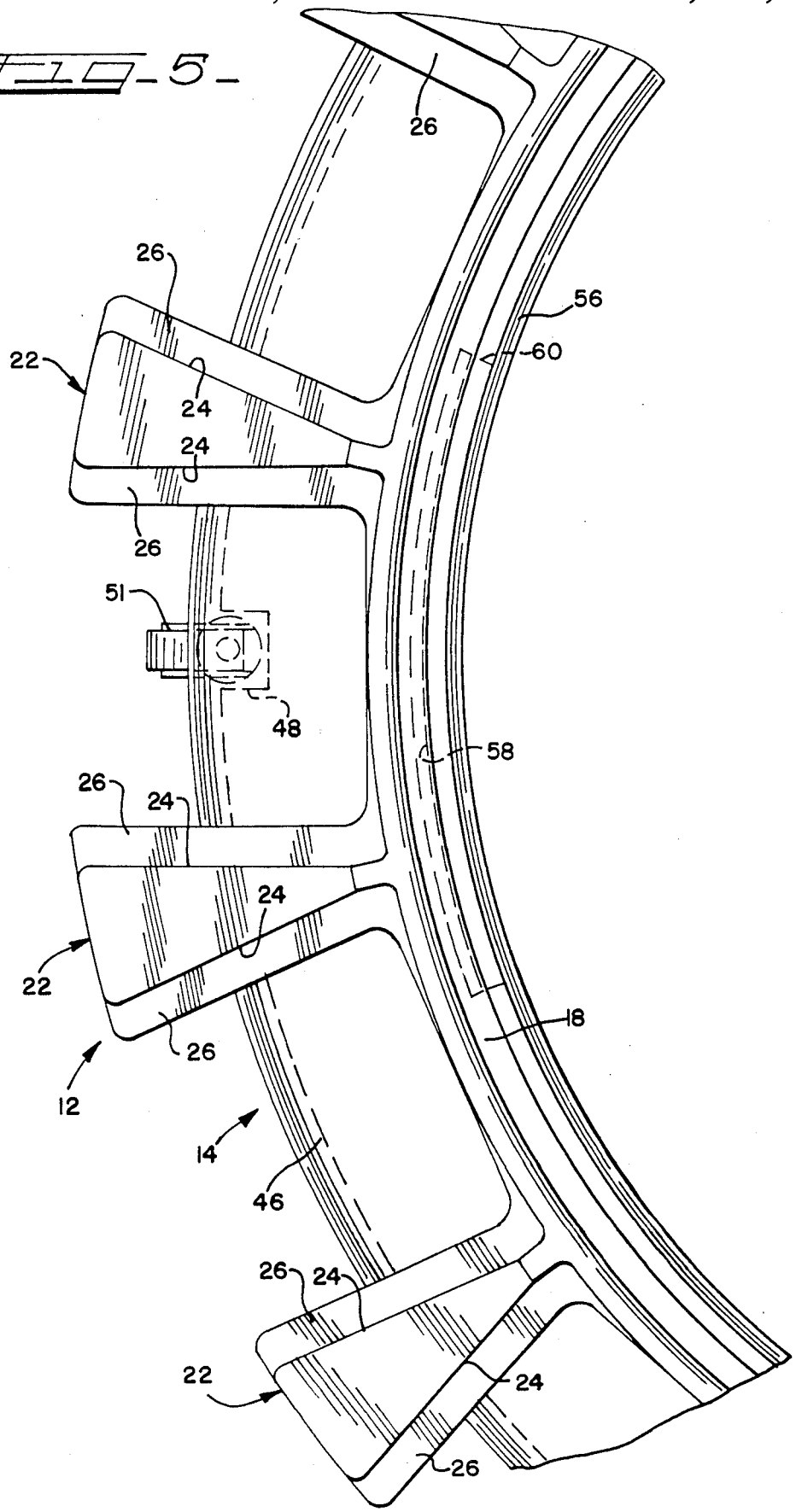
FIG. 5 is a view taken generally along lines 5—5 of FIG. 3.

Referring now particularly to FIGS. 2, 3, and 5, the construction of the rack members 12 will be described. Each of the rack members 12 is of a generally circular, ring-like annular configuration, and includes a generally vertically oriented circular inner portion 18. To facilitate secure, yet releasable, stacking of the rack members, the inner portion 18 of each member defines a downwardly opening annular groove 20 which is adapted to receive the upper extent of the inner portion 18 of the rack member 12 positioned therebeneath. As will be further described, the annular groove 20 performs a dual function in the sense that it can also serve as a bearing race for rotational support of the rack members 12 on base 14.

Each rack member 12 further includes a plurality of circumferentially spaced, outwardly extending spoke-like support members 22. The exact configuration of each support member 22 can be varied in accordance with the desired overall size of each rack member 12, and according to the size and shape of objects to be supported in the storage device. In the preferred form, each support member 22 defines a pair of oppositely disposed side surfaces 24 which generally taper toward each other as they extend inwardly of the rack member. Additionally, each support member 22 includes a pair of oppositely disposed support flanges 26 which extend from the respective side surfaces 24. Preferably, each support flange 26 is disposed in parallel relation to its respective side surface 24 of the support member 22.

As shown in the drawings, the film cartridges C to be stored are positionable between adjacent ones of the support members 22 of the rack members 12. In order to provide secure support for the film cartridges, the confronting side surfaces 24 of adjacent ones of the support members 22 are preferably disposed in parallel relation to each other such that one of the generally rectangular film cartridges is received securely therebetween for support upon the confronting support flanges 26 of the adjacent support members 22.

In order to further facilitate convenient stacking of rack members 12 upon each other, and to facilitate their convenient rotation together atop of base 14, each support member 22 of the rack members preferably includes interconnecting means for releasably interconnecting each support member with the support members positioned immediately thereabove and therebeneath. In the illustrated embodiment, such interconnecting means include a generally downwardly open groove 28 for receiving an upper edge portion of the support member 22 positioned in alignment therebeneath; integrally molded alignment lugs and lug-receiving cavities can alternately be employed. Thus, the provision of grooves 20 and 28 in each rack member 12 permits any selected number of the rack members to be easily vertically stacked in aligned relation.

In order to minimize the material required for formation of each of rack members 12, each of support members 22 is preferably of substantially hollow configuration, as indicated by the hollowed out area at 30. Additionally, it should be noted that the support flanges 26 of each rack member are preferably configured so as to support film cartridges C at an incline downwardly and inwardly of the storage device. This preferred configuration acts to maintain objects stored in the storage device in position during rotation of rack members 12.

In the preferred form of the present storage device 10, the device includes the top cover member 16 for releasable positioning upon the uppermost one of the rack members 12. As best shown in FIGS. 2 and 3, cover member 16 comprises a generally circular panel 34 from which depends an annular flange 36. Annular flange 36 defines a downwardly opening annular groove 38 of similar configuration as the annular grooves 20 of rack members 12. Thus, the groove 38 of top cover member 16 is adapted to releasably receive the upper extent of the inner portion 18 of the uppermost rack member 12. In order to further retain cover member 16 in position atop the rack members, the cover member preferably includes a plurality of circumferentially spaced radial webs 40 each defining a generally downwardly opening receiving groove 42. Receiving grooves 42 are adapted to respectively receive an upper edge portion of the support members 22 of the uppermost rack member 12, with this configuration acting to retain the cover member in position, but permitting it to be easily removed for increasing or decreasing the number of the rack members.

Figure 4:
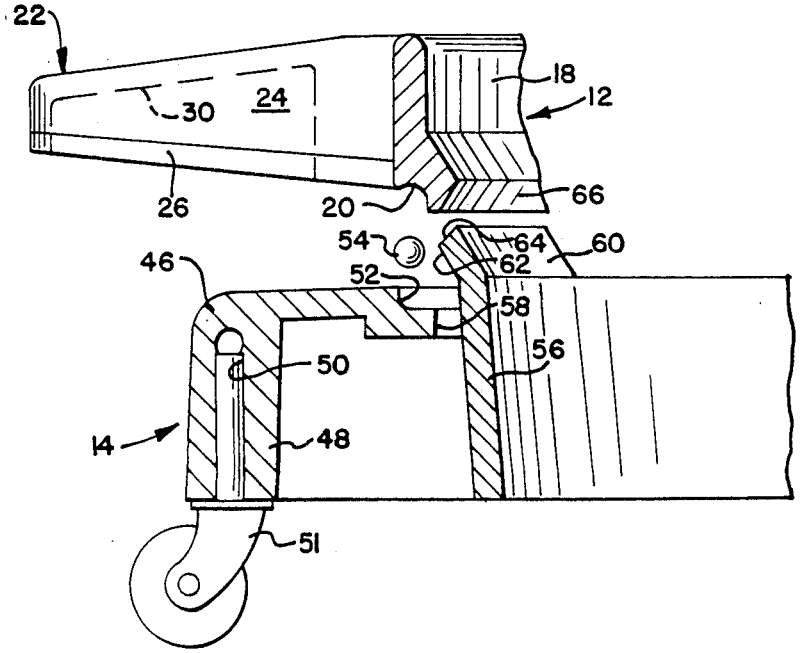
FIG. 4 is a view similar to FIG. 3 illustrating assembly of the present storage device.

With particular reference to FIGS. 2, 3, and 4, the configuration of base 14 of storage device 10 will now be described. In the illustrated embodiment, base 14 includes a generally annular outer portion 46, which in the preferred form includes a plurality of circumferentially spaced caster bosses 48. Each caster boss 48 defines a downwardly opening caster socket 50, thus facilitating convenient mounting of the base 14 on caster wheels 51 so that the entire storage device 10 is moveably supported.

A particularly notable feature of the base 14 is the provision of a generally upwardly opening annular groove 52 defined thereby. Significantly, annular groove 52 acts as a first bearing race for effecting rotational mounting of rack members 12 upon the base. As best shown in FIGS. 3 and 4, a plurality of ball bearings 54 (one being shown) are positionable within annular groove 52, with the annular groove 20 of the lowermost one of the rack members 12 providing a second bearing race when positioned atop the base as illustrated. As will be recognized, this construction provides the desired rotational mounting of the rack members 12 by a straightforward and readily fabricated construction, avoiding the need for additional hardware or like components.

Base 14 further includes an inner base portion 56 disposed generally within the outer portion 46, with the inner base portion 56 integrally connected with the outer base portion by a slotted web portion extending inwardly from annular groove 52. This preferred unitary, one-piece construction of the base 14 facilitates its economical manufacture.

In order to retain the lowermost one of rack members 12 in association with the base 14 for relative rotational movement, inner base portion 56 defines a plurality of circumferentially spaced retaining fingers 60. As best shown in FIG. 5, the web which joins inner and outer base portions 56 and 46 defines a plurality of circumferentially spaced slots 58, with the slots 58 corresponding in length and positioning to the retaining fingers 60. As will be recognized, the provision of slots 58 facilitates injection molding of the base 14.

Each retaining finger 60 defines a retaining surface 62 which is reactive with the interior surface of inner portion 18 of the rack member 12 positioned immediately atop the base 14. To facilitate convenient mounting of one of the rack members 12 on the base 14 for rotational movement, each of retaining fingers 60 is resiliently flexible. In this regard, each finger 60 preferably defines a cam surface 64 which is reactive with a cam surface 66 defined by the inner portion 18 of each rack member 12.

As illustrated in FIG. 4, rotational mounting of the lowermost one of rack members 12 on base 14 is readily effected by disposition of ball bearings 54 in annular groove 52 of the base, followed by relative downward movement of the lowermost rack member 12 onto the base. During movement in this manner, cam surfaces 64 of the retaining fingers 60 react against the cam surface 66 of the lowermost rack member, thus urging the fingers 60 generally inwardly of the base 14. As this one of the rack members is fully seated such that its annular groove 20 is positioned for providing the second bearing race for ball bearings 54, the respective cam surfaces 64 and 66 move out of engagement, and retaining fingers 60 "spring back" to their original disposition such that their respective retaining surfaces 62 are positioned for retaining the rack member 12 in position for relative rotational movement.

Thus, a modular storage device is disclosed which facilitates convenient and efficient storage of a large number of microfilm cartridges or like objects. The modular nature of the construction provides desired versatility and flexibility of use, with economical use promoted by the material-saving configuration of the device. Manufacture of the device from "structural foam" further promotes its economical fabrication, and readily permits selected ones of the rack members 12 to be "color-coded" to further promote efficient use of the device.

While the present storage device has been described as suitable for storage of microfilm cartridges, it will be recognized that the versatile nature of the construction permits its use for storage or display of many different objects. For example, the present device can be readily configured for holding magnetic tape cassettes, such as for retail display. Similarly, the present invention can be readily sized for home use such as for storing cassettes or the like. Again, the modular nature of the construction provides very desirable versatility since the storage capacity of the unit can be readily selected as required.

From the foregoing, it will be observed that numerous modifications and variations can be effected without departing from the true spirit and scope of the novel concept of the present invention. It will be understood that no limitation with respect to the specific embodiment disclosed is intended or should be inferred. It is, of course, intended to cover by the appended claims all such modifications as fall within the scope of the claims.

What is claimed:

1. A modular storage device for storing a plurality of generally like objects, comprising:

a base; and a plurality of vertically stackable rack members positionable in vertically aligned relation on said base, each said rack member being of unitary, one-piece construction, and having a generally circular configuration, including a circular inner portion, and a plurality of circumferentially spaced support members extending integrally outwardly from said circular inner portion, each said support member extending freely outwardly from said circular inner portion and terminating in a free end portion, each said support member defining a pair of opposite side surfaces, and including a pair of support flanges on respective opposite sides of the support member extending away from said side surfaces, the confronting side surfaces of adjacent ones of said support members of any one of said rack members being disposed in spaced relation to each other to define a receiving area between adjacent ones of said support members for receiving one of said objects for support upon the confronting and spaced apart support flanges of adjacent ones of said support members, said base of said device defining an annular groove for providing first bearing race means, the inner portion of each one of said rack members defining a downwardly opening annular groove for providing second bearing race means, whereby any one of said rack members can be positioned immediately atop of said base for relative rotational movement by disposition of ball bearing means between said first and second bearing race means.

2. The modular storage device of claim 1, wherein the support flanges of said support members are configured for supporting each said object in an inwardly, downwardly inclined position.

3. The modular storage device of claim 1, wherein each said support member includes interconnecting means for releasably interconnecting the support member with another one of the support members of one of said rack members positioned immediately therebeneath to facilitate vertical stacking of said rack members and to fix said rack member against rotation with respect to each other.

4. The modular storage device of claim 1, wherein said downwardly opening annular groove of each said rack member is configured to releasably receive the upper extent of the circular inner portion of another one of said rack members positioned therebeneath.

5. The modular storage device of claim 1, wherein said base includes retaining means reactive with the inner portion of the one of said rack members positioned immediately above said base for retaining said one rack member for relative rotational movement.

6. The modular storage device of claim 5, wherein said retaining means comprises a plurality of circumferentially spaced, resiliently flexible retaining finger means.

7. The modular storage device of claim 1, including a top cover member positionable atop the uppermost one of said rack members, said cover member defining means for releasably receiving the upper extent of the inner portion of said uppermost rack member, and means for releasably receiving the upper extent of each support member of said uppermost rack member.

8. The modular storage device of claim 1, wherein the confronting side surfaces of adjacent ones of said support members are disposed in generally parallel spaced relation.

9. The modular storage device of claim 1, wherein each said support member is of substantially hollow configuration for minimizing the material required for formation of said rack members.

10. A modular storage device for storing a plurality of objects, comprising:

a base; and a plurality of vertically stackable rack members positionable in vertically aligned relation on said base, each said rack member including an inner portion and support means extending outwardly thereof for supporting a plurality of said objects, said base defining first bearing race means, and the inner portion of each of said rack members defining second bearing race means, whereby said rack members are supported for rotational movement relative to said base by the disposition of ball bearing means between said first bearing race means and the second bearing race means provided by the lowermost one of said rack members positioned immediately atop of said base, said second bearing race means of each said rack members comprising an annular groove defined by the inner portion thereof, the annular groove of each rack member being configured to releasably receive the inner portion of one of said rack members positioned therebeneath.

11. The modular storage device of claim 10, wherein said base includes integral means reactive with the inner portion of the lowermost one of said rack members for retaining the lowermost rack member in association with said base for relative rotational movement.

12. The modular storage device of claim 11, wherein said base includes an outer portion defining an annular groove which provides said first bearing race means, said base further including an inner portion integral with said outer portion which defines said retaining means, said retaining means comprising a plurality of circumferentially spaced, resiliently flexible retaining finger means.

13. The modular storage device of claim 12, wherein each said finger means defines a retaining surface configured for coaction with the inner portions of said rack members to retain the lowermost one of said rack members on said base, and cam means configured to coact with the inner portions of said rack members whereby said finger means are resiliently urged inwardly of said base by relative downward movement of the lowermost one of said rack members, whereafter said finger means spring outwardly so that said retaining surfaces retain said lowermost rack member on said base.

14. The modular storage device of claim 13, wherein said base defines a plurality of downwardly, opening sockets for receiving caster wheel means.

15. The modular storage device of claim 10, wherein said support means of each said rack member comprises a plurality of circumferentially spaced support members extending outwardly of the inner portion of each rack member, each said support member defining support flange means whereby one of said objects is positionable upon the support flange means of adjacent ones of said support members of any one of said rack members.

* * * * *